US012276011B2

(12) United States Patent
Cinca I Luis et al.

(10) Patent No.: US 12,276,011 B2
(45) Date of Patent: Apr. 15, 2025

(54) LIGHTWEIGHT CEMENTED CARBIDE

(71) Applicant: HYPERION MATERIALS & TECHNOLOGIES, INC., Worthington, OH (US)

(72) Inventors: Nuria Cinca I Luis, Barcelona (ES); Laura Larrimbe, Barcelona (ES); Jose Maria Tarrago, Barcelona (ES); Stefan Ederyd, Saltsjo-Boo (SE)

(73) Assignee: HYPERION MATERIALS & TECHNOLOGIES, INC., Worthington, OH (US)

( * ) Notice: Subject to any disclaimer, the term of this patent is extended or adjusted under 35 U.S.C. 154(b) by 933 days.

(21) Appl. No.: 17/425,403

(22) PCT Filed: Jan. 23, 2020

(86) PCT No.: PCT/EP2020/051668
§ 371 (c)(1),
(2) Date: Jul. 23, 2021

(87) PCT Pub. No.: WO2020/152291
PCT Pub. Date: Jul. 30, 2020

(65) Prior Publication Data

US 2022/0098710 A1 Mar. 31, 2022

(30) Foreign Application Priority Data

Jan. 24, 2019 (GB) ..... 1900988

(51) Int. Cl.

| | |
|---|---|
| ***C22C 29/02*** | (2006.01) |
| ***C22C 1/051*** | (2023.01) |
| ***C22C 29/00*** | (2006.01) |
| *B22F 3/16* | (2006.01) |

(52) U.S. Cl.
CPC ..... *C22C 29/02* (2013.01); *C22C 1/051* (2013.01); *C22C 29/005* (2013.01); *B22F 3/16* (2013.01); *B22F 2301/15* (2013.01); *B22F 2302/10* (2013.01); *B22F 2302/15* (2013.01); *B22F 2302/20* (2013.01); *B22F 2998/10* (2013.01)

(58) Field of Classification Search
CPC ..... C22C 29/02
See application file for complete search history.

(56) References Cited

U.S. PATENT DOCUMENTS

| | | | | |
|---|---|---|---|---|
| 5,068,149 | A * | 11/1991 | Shimada | C22C 29/08 428/401 |
| 2004/0091749 | A1* | 5/2004 | Mikus | C23C 8/80 427/249.1 |
| 2005/0126336 | A1* | 6/2005 | Jansson | C23C 30/005 75/240 |
| 2011/0150692 | A1 | 6/2011 | Roediger | |

FOREIGN PATENT DOCUMENTS

| | | | |
|---|---|---|---|
| JP | 2006144089 | A | 6/2006 |
| JP | 2012193430 | A | 10/2012 |

OTHER PUBLICATIONS

"Cermets and Cemented Carbides," ASM Handbook, vol. 7 (1998), pp. 921-940.*

* cited by examiner

*Primary Examiner* — Christopher S Kessler
(74) *Attorney, Agent, or Firm* — Ari G. Zytcer

(57) ABSTRACT

Provided is a cemented carbide suitable for use as a material in the manufacture of a punch for metal forming and in particular for the manufacture of metal beverage cans. The cemented carbide may include a hard phase that includes WC, a binder phase and a gamma phase. The gamma phase may include metal carbides in combination with metal nitrides or metal carbonitrides. A quotient of the average grain size of WC/the average grain size of the gamma phase may be in a range of from 0.5 to 1.5.

15 Claims, 11 Drawing Sheets

(b)

(a)

(b)

(a)

(b)

(a)

(b)

(a)

LIGHTWEIGHT CEMENTED CARBIDE

This is a National Phase Application filed under 35 U.S.C. 371 as the national stage of PCT/EP2020/051668, filed on Jan. 23, 2020, an application claiming the benefit of Great Britain Patent Application No. 1900988.5, filed on Jan. 24, 2019, the entire content of each of which is hereby incorporated by reference in its entirety.

FIELD OF DISCLOSURE

The present subject matter relates to a cemented carbide having a hard phase, a binder phase and a gamma phase and in particular although not exclusively to a gamma phase comprising metal carbides and metal nitrides and/or metal carbonitrides.

BACKGROUND

Cemented carbides are known to exhibit a favourable combination of high hardness and moderate toughness making them ideal materials for use in manufacturing wear resistant applications including material-forming tools, structural components, mining bits, press moulds, punch dies and other wear parts in high demand applications. In particular, cemented carbides have been used to form punch bodies in the manufacturing of metal beverage cans. Over 200 billion cans are produced worldwide every year. A single production line can make up to 500 k cans per year in a continuous process from aluminium or steel strip. Additionally, horizontal presses can run at speeds of 250 to 390 cans per minute. As part of the process, a cup, pressed from the metal sheet, is formed into the can body in one continuous punch stroke in about one fifth of a second, forming the inside diameter of about 66 mm, and increasing the height from 33 to 57 mm. Then the can body is then typically passed through ironing rings, to stretch the wall to 130 mm high, before forming a concave dome at the can base. Due to the very tight tolerances required for the tooling (±0.002 mm) and to keep the correct can dimensions, alignment of the punch with respect to the ironing rings and dome die is important.

EP 2439294 A1 describes a cemented carbide composition having a hard phase including WC and a binder phase with the composition comprising in wt % from 50 to 70 WC, from 15 to 30 TiC and from 12 to 20 Co+Ni.

U.S. Pat. No. 6,521,353 B1 describes a low thermal conductivity hard metal for high wear applications such as use as a face of a pelletizing die. The material comprises WC at 50 to 80 wt %, TiC in at a least 10 wt %, a binder material comprising nickel and cobalt in which TiN and TiNC are not added to the alloy.

The lightweight punches as described in EP 2439294 A1 are intended to provide a reduced mass at the end of the operating ram to decrease the punch dynamic oscillations to try and achieve higher punch body speeds (cans per minute) and improved can wall thickness consistency which in turn requires less metal and reduces the carbon footprint. However, such materials represent a compromise between an attempt to achieve the above advantages versus maximising the service lifetime due to wear resistance. Accordingly, there is a need for a lightweight hard metal grade material exhibiting the appropriate hardness and toughness and accordingly wear resistance.

SUMMARY

The present disclosure is directed to lightweight cemented carbide materials having desired wear resistance and mechanical properties suitable for use to make tooling and components for high demand applications. Also provided are cemented carbide materials for the manufacture of a punch for metal forming having a density of approximately 10 g/cm$^3$ in combination with exhibiting high mechanical wear resistance and preferably corrosion resistance.

Also provided are cemented carbides having physical and mechanical characteristics to enable a surface roughening procedure particularly when the material is used for the manufacture of a punch for metal forming such as a body maker punch forming an end or attachable to an end of a ram as part of metal can manufacture.

The objectives are achieved by providing a cemented carbide formed from three or at least three phases including a WC phase, a binder phase and a gamma phase. The present cemented carbide is specifically configured with a gamma phase comprising metal carbides in combination with metal nitrides and/or metal carbonitrides and having a particular ratio or quotient of average grain size of the WC phase to the average grain size of the gamma phase. In particular, the inventors have identified that a quotient of WC average grain size/gamma phase average grain size in the range 0.5 to 1.5 is particularly advantageous in combination with the recited gamma phase composition to provide a material exhibiting high hardness, moderate toughness and a density of less than 14 g/cm$^3$ and in particular approximately or nearly 10 g/cm$^3$. Accordingly, the present cemented carbide for use as a tool for punching metal is advantageous to achieve similar wear rates to conventional much higher density cemented carbides typically used for punch applications whilst being appreciably lighter. This in turn is advantageous to provide higher punch speeds, improved can body wall consistency (of the as-formed can) which in turn requires less aluminium or steel strip to reduce the carbon foot print. Further advantages include reduced average can weight, spoilage, maintenance and machine down time.

The present grade may also be advantageous for use in the manufacture of components in a variety of applications including in particular use a saw tip, a cutting die, a cutting component, a mining bit, a component within a press mould, a drill, a bearing or component within a bearing, a mechanical seal and the like.

The present material composition utilises a combination of cubic metal carbides with cubic metal nitrides and/or cubic metal carbonitrides that provides i) grain growth inhibition of the gamma phase, ii) improved corrosion resistance, iii) improved hot hardness and iv) minimised density to provide a lightweight carbide material. Optionally, the gamma phase forming components may be pre-alloyed raw materials to contribute to the desired physical and mechanical characteristics including in particular low density, high hardness, moderate toughness and importantly high wear resistance.

There is provided a cemented carbide comprising a hard phase including WC, a binder phase and a gamma phase characterised in that: the cemented carbide comprises WC in the range 50 to 70 wt %; a quotient of the average grain size of WC/the average grain size of the gamma phase is in a range 0.5 to 1.5; and the gamma phase comprises at least one metal carbide in combination with at least one metal nitride and/or metal carbonitride.

Optionally, the metal carbides, metal nitrides and/or metal carbonitrides comprise anyone or a combination of: Ti, Ta, V, Nb, Zr, Hf. Optionally, the cemented carbide comprises TiC, NbC, TaC and/or TiCN. In particular, the gamma phase of the cemented carbide comprise a cubic mixed carbide and preferably (Ti, Ta, Nb, W)C. Such a composition is advantageous to improve strength, toughness and wear resistance and in turn provide better performance as a tool for metal forming, processing and/or machining.

Addition of metal nitride and/or metal carbonitrides is advantageous for grain refinement of the gamma phase predominantly or exclusively with regard to the hard WC containing phase. Nitrogen may be added in the form Me(C, N) where Me is any one of or a combination of Ti, Ta, V, Nb, Zr, Hf, W, Mo, Cr.

Optionally, an average grain size of the WC is in a range 0.5 to 2 μm; 0.75 to 2 μm; 0.8 to 2 μm; 0.8 to 1.8 μm; or 0.8 to 1.4 μm. Optionally, an average grain size of the gamma phase is in a range 0.5 to 2 μm; 0.75 to 2 μm; 0.8 to 2 μm; 0.8 to 1.8 μm or 1 to 1.6 μm. The recited ratio or quotient of the average WC grain size/average gamma grain size is particularly advantageous to reduce grain pull out and cracking in addition to improving adhesion between the different phases of the cemented carbide.

Optionally, the cemented carbide may further comprise Mo. Optionally, the cemented carbide may include Mo in a range wt % 0.1-0.7; 0.2-0.6 or 0.3-0.6. This is beneficial to improve the mechanical properties, corrosion resistance and binder-carbide adhesion. Optionally, Mo may be present in elemental, carbide form and/or mixed carbide form.

Optionally, the cemented carbide may further comprise Cr. Optionally, the cemented carbide may comprise Cr in a range wt % 0.1-0.7; 0.2-0.6 or 0.3-0.6. This is beneficial to improve the mechanical properties, corrosion resistance and binder-carbide adhesion. Optionally, Cr may be present in elemental, carbide form and/or mixed carbide form Optionally, the WC is included in a range wt % 50-65; 52-62; 54-60; or 55-59. Accordingly, the present cemented carbide is at least a tri-phase material. The cemented carbide preferably comprises WC as balance within any and all compositions described herein.

Optionally, the binder phase comprises Co and Ni. Preferably, the binder phase comprises Co+Ni. Preferably, the binder phase includes further elements and/or compounds. Optionally, the binder phase further comprises any one or a combination of Fe, Cr, Mo. The cemented carbide comprising a base of cobalt and nickel is advantageous for improved corrosion resistance optionally with incorporation of molybdenum. Optionally, the cemented carbide comprises Co+Ni in a range wt % 10-20.

Optionally, the cemented carbide comprises in wt %: 50-70 WC; 10-20 Co+Ni; 10-14 TiC; 8-12 NbC; 0.5-2.5 TaC; 0.1-1.0 $Cr_3C_2$; 0.1-1.0 $Mo_2C$; 1-7 TiCN and/or 1-5 TiN. Optionally, the cemented carbide comprises in wt %: 50-70 WC; 5-13 Co; 1-9 Ni; 10-14 TiC; 8-12 NbC; 0.5-2.5 TaC; 0.1-1.0 $Cr_3C_2$; 0.1-1.0 $Mo_2C$; 1-7 TiCN and/or 1-5 TiN. Optionally, the cemented carbide comprises in wt %: 50-65 WC; 7-11 Co; 3-7 Ni; 10-14 TiC; 8-12 NbC; 0.5-2.5 TaC; 0.3-0.7 $Cr_3C_2$; 0.3-0.7 $Mo_2C$; 2-6 TiCN and/or 1-5 TiN.

Optionally, the cemented carbide consists of in wt %: 50-70 WC; 10-20 Co+Ni; 10-14 TiC; 8-12 NbC; 0.5-2.5 TaC; 0.1-1.0 $Cr_3C_2$; 0.1-1.0 $Mo_2C$; 1-7 TiCN and/or 1-5 TiN. Optionally, the cemented carbide consists of in wt %: 50-70 WC; 5-13 Co; 1-9 Ni; 10-14 TiC; 8-12 NbC; 0.5-2.5 TaC; 0.1-1.0 $Cr_3C_2$; 0.1-1.0 $Mo_2C$; 1-7 TiCN and/or 1-5 TiN. Optionally, the cemented carbide consists of in wt %: 50-65 WC; 7-11 Co; 3-7 Ni; 10-14 TiC; 8-12 NbC; 0.5-2.5 TaC; 0.3-0.7 $Cr_3C_2$; 0.3-0.7 $Mo_2C$; 2-6 TiCN and/or 1-5 TiN.

Optionally, the present cemented carbide may further include any of V, Re, Ru, Zr, Al and/or Y at impurity levels. These elements may be present either in elemental, carbide, nitride or carbonitride form. The impurity level is a level such as less than 0.1 wt % for the total amount of impurities present within the cemented carbide.

Reference within this specification to powdered (starting) materials encompass starting materials that form the initial powder batch for possible milling, optional formation of a pre-form compact and subsequent/final sintering. Optionally, the metal carbide, metal nitride and/or metal carbonitride that form the gamma phase are added to a pre-milled powdered batch as pre-alloyed gamma phase components. Accordingly, the gamma phase within the final sintered material is a product resulting from a powdered batch of pre-alloyed gamma phase compounds. Such pre-alloyed gamma phase components are advantageous to inhibit grain growth of the gamma phase (and potentially the WC hard phase) during sintering so as to provide in turn increased adhesion between the different phases and increased resistance to grain pull-out.

There is also provided a tool for metal forming or metal cutting comprising a cemented carbide as claimed herein.

There is also provided a punch for metal forming comprising a cemented carbide as claimed herein. There is also provided a method of making a cemented carbide comprising a hard phase including WC, a binder phase and a gamma phase, the method comprising: preparing a batch of powdered materials comprising WC in the range 50 to 70 wt %, binder phase constituents and gamma phase constituents that include at least one metal carbide in combination with at least one metal nitride and/or metal carbonitride; milling the powdered materials; pressing the milled powdered materials to form a pre-compact; and sintering the pre-compact; wherein within the sintered pre-compact, a quotient of the average grain size of WC/the average grain size of the gamma phase is in a range 0.5 to 1.5. Optionally, WC is included within the powdered materials at wt % 50-65; 52-62; 54-60; or 55-59.

Optionally, the metal carbides, metal nitrides and/or metal carbonitrides included within the powdered materials comprise any one or a combination of the elements: Ti, Ta, V, Nb, Zr, Hf, W.

Optionally, the gamma phase constituents within the powdered materials comprise TiC, NbC, TaC, TiN and/or TiCN.

Optionally, the powdered batch further comprises Cr, Mo, $Cr_3C_2$, MoC and/or $Mo_2C$. Optionally, the powdered batch further comprises Co and Ni and optionally Co, Ni, Fe, Cr and Mo to form the binder phase.

Optionally, the powdered batch comprises in wt %: 55-59 WC; 10-14 TiC; 8-12 NbC; 5-13 Co; 0.1-1.0 $Cr_3C_2$; 1-9 Ni; 0.1-1.0 $Mo_2C$; 0.5-2.5 TaC; 1-7 TiCN and/or 1-5 TiN.

Optionally, the powdered batch consists of in wt %: 55-59 WC; 10-14 TiC; 8-12 NbC; 5-13 Co; 0.1-1.0 $Cr_3C_2$; 1-9 Ni; 0.1-1.0 $Mo_2C$; 0.5-2.5 TaC; 1-7 TiCN and/or 1-5 TiN.

BRIEF DESCRIPTION OF DRAWINGS

A specific implementation of the present invention will now be described, by way of example only, and with reference to the accompanying drawings in which.

DETAILED DESCRIPTION

Figure 1:
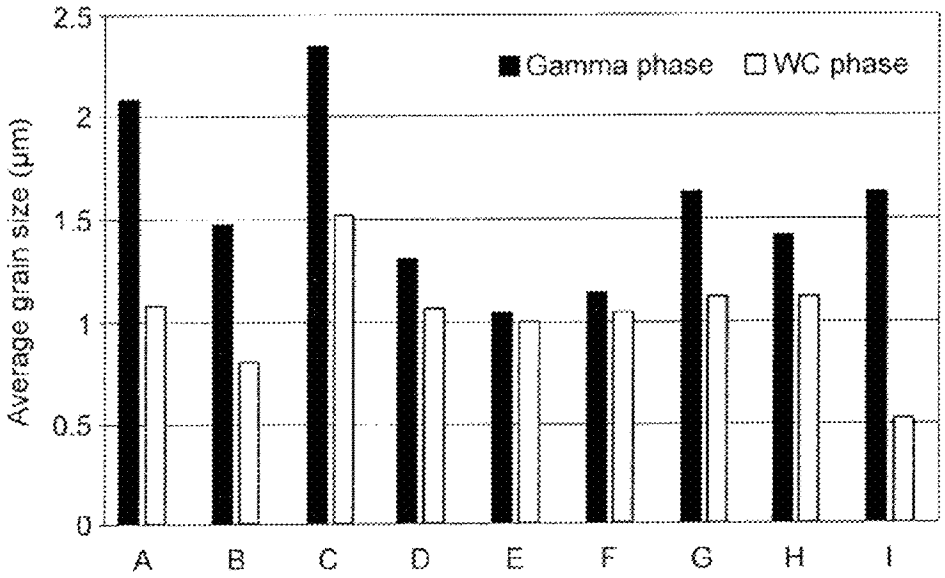
FIG. 1 is a graph of average grain size (μm) of the gamma phase and WC phase of samples A to G according to specific aspects of the present invention.

The inventors have identified a cemented carbide material having improved toughness for alike hardness levels of existing materials for example as described in EP 2439294 A1 with a corresponding low density so as to provide a lightweight component. When utilised as a punch for metal forming and in particular as a punch for the manufacture of beverage cans, the present material exhibits lower wear rates during linear reciprocation against $Al_2O_3$, lower adhesion of aluminium during linear reciprocating wear tests, improved surface characteristics to enable surface roughening in addition to moderate to high corrosion resistance.

The desired physical and mechanical characteristics are achieved, at least in part, by controlling the average grain size of the gamma phase with regard to the hard phase WC in combination with selecting appropriate constituents of the gamma phase being formed from metal carbides, metal nitrides and/or metal carbonitrides. In particular, the present material grade achieves selective refinement of the gamma phase only. Such refinement is achieved by the combination of cubic metal carbides with cubic metal nitrides and/or cubic metal carbonitrides. Additionally, the present composition may utilise pre-alloyed gamma phase materials within the initial powdered batch.

Examples

Conventional powder metallurgical methods including milling, pressing, shaping and sintering were used to manufacture various sample grades of a cemented carbide according to the present invention. In particular, cemented carbide grades with the compositions in wt % according to Table 1 were produced according to known methods. Grades A to I were prepared from powders forming the hard constituents, powders forming the binder and powders forming the gamma phase. Each of the sample mixtures Grades A to I were prepared from powders forming the hard constituents and powders forming the binder. The following preparation method corresponds to Grade G of Table 1 below having starting powdered materials: WC 44.36 g, $Cr_3C_2$ 0.37 g, Co 5.98 g, Ni 2.99 g, NbC 11.91 g, $Mo_2C$ 0.37 g, TiC 5.59 g, TaC 1.12 g, TiN 0.19 g, PEG 2.25 g, Ethanol 50 ml. It will be appreciated by those skilled in the art that it is the relative amounts of the powdered materials that allow the skilled person and suitable adjustment is needed to make the powdered batch and achieve the final fully sintered composition of the cemented carbides of Table 1.

Each of the sample mixtures were subjected to **8*h*** of ball milling using ethanol as liquid media and afterwards dried in a furnace (65° C.) and sieved. The powders were uniaxially pressed at 4 Tm. Green compacts were then deppeged at 450° C. and sintered in a SinterHIP at 1410° C. (70 min) in argon atmosphere (50 bar). PEG was introduced in all compositions. Some other sintering trials at higher temperatures were carried out, but no significant differences in terms of final grain coarsening were observed.

TABLE 1

Example grade material compositions A to I according to the present invention

| | Composition % | | | | | | | | | | |
|---|---|---|---|---|---|---|---|---|---|---|---|
| Grade | WC | TiC | NbC | Co | $Cr_3C_2$ | Ni | Mo | $Mo_2C$ | TaC | TiN | Pre alloyed γ-phase |
| A | 62.30 | 12.00 | 12.00 | 7.00 | 1.00 | 2.50 | 0.20 | | 3.00 | | No |
| B | 62.30 | 12.00 | 12.00 | 7.00 | 1.00 | 2.50 | 0.20 | | 3.00 | | Yes |
| C | 59.30 | 15.00 | 15.00 | 6.50 | 0.50 | 3.50 | 0.20 | | | | No |
| D | 59.30 | 10.00 | 15.00 | 6.50 | 0.50 | 3.50 | 0.20 | | | 5.00 | No |
| E | 57.00 | 12.00 | 10.50 | 9.00 | 0.50 | 5.00 | | 0.50 | 1.50 | 4.00 | Yes |
| F | 56.50 | 10.50 | 10.50 | 9.00 | 0.50 | 5.00 | | 0.50 | 2.00 | 5.50 | No |
| G | 59.50 | 7.50 | 16.00 | 8.00 | 0.50 | 4.00 | | 0.50 | 1.50 | 2.50 | No |
| H | 58.00 | 12.00 | 10.50 | 8.00 | 0.50 | 5.00 | | 0.50 | 1.50 | 4.00 | No |
| I | 63.20 | 20.80 | | 8.20 | 2.00 | 5.60 | 0.20 | | | | No |

The average grain size of the WC powders and gamma phase constituent powders was varied for grades A to I as detailed in FIG. 1. Medium coarse grain WC powder was used to assist reduction of differences in the grain size with the gamma phase.

Characterisation

Characterisation of the sample grades was undertaken including magnetic properties; microstructure, density, hardness and toughness and sliding wear performance.

Magnetic Properties

Coercivity force, Hc, and magnetic saturation of Co, Com, were measured in all sintered samples to study if eta-phase or graphite were present in the microstructure.

Microstructure, Density, Hardness and Toughness

The density of the sintered alloys was measured by Archimedes method as well as theoretically calculated.

Sintered samples were then mounted in bakelite resin and polished down to 1 μm prior to further characterization. Microstructural analysis was carried out using scanning electron microscopy (SEM) and energy dispersive X-ray spectroscopy (EDS). Vickers indentation test was performed using 30 kgf (HV30) to assess hardness. Palmqvist fracture toughness was calculated according to $$K1c = A\sqrt{HV}\sqrt{\frac{P}{\Sigma L}}$$

where A is a constant of 0.0028, H is the hardness (N/mm2), P is the applied load (N) and ΣL is the sum of crack lengths (mm) of the imprints.

The linear intercept method (ISO 4499-2:2008) is a method of measurement of WC grain size. Grain-size measurements are obtained from SEM images of the microstructure. For a nominally two-phase material such as a cemented carbide (hard phase and binder phase), the linear-intercept technique gives information of the grain-size distribution. A line is drawn across a calibrated image of the microstructure of the cemented carbide. Where this line intercepts a grain of WC, the length of the line ($l_i$) is measured using a calibrated rule (where i=1, 2, 3, . . . n for the first $1^{st}$, $2^{nd}$, $3^{rd}$, . . . , nth grain). At least 100 grains where counted for the measurements. The average WC grain size will be defined as:

$$d_{wc}=\Sigma l_i/n$$

Sliding Wear Test

Can tooling is one of the main applications in which the use of lightweight grades would be an improvement in the metal forming process when used for the carbide punches. Replicating can tooling conditions implies testing wear damage in samples which have been previously texturized in similar way to the ones used in the field (crosshatching). This operation leaves a rough surface finish that facilitates the mechanical bonding of aluminum. The methodology used to assess wear behaviour is described below:

- Sintered samples, were grinded to achieve Ra~0.15-0.25 μm.
- The samples were then mounted in a bakelite and to simulate the crosshatching procedure, were texturized using a diamond pad RED 3M in a polishing machine (30N, 50 rpm and contra-rotation in lubricated conditions). The intention was to achieve Ra~0.25-0.35 μm in the end product.
- The samples were afterwards dismounted from the bakelite and placed in a circular geometry holder designed for Wazau wear tester.
- The Wazau wear tester in a linear reciprocating module was used according to ASTM G133 "Test Method for Linearly Reciprocating Ball-on-Flat Sliding Wear". $Al_2O_3$ balls of Ø10 mm were used for characterizing abrasive wear. Galling or adhesive wear damage was tested utilizing Al balls of the same size. Conditions used were: load=150N, speed=250 rpm, stroke length=10 mm, sample frequency=100 Hz (for 1 h test). Samples were immersed in lubricant while testing to simulate the real process.
- During each wear experiment the imposed normal contact force ($F_N$) and the concomitant tangential friction force ($F_T$) of pin-on-flat sliding pairs were continuously registered. The coefficient of friction (μ) is calculated from the $F_T/F_N$ forces ratio.

After the test, the wear damage pattern was evaluated by SEM and confocal interferometry. Wear resistance was evaluated from measuring the depth of the wear tracks from the 2D profiles.

Results

Material Characterization

With a view to achieving a hard metal grade with low density (i.e. bellow 10.30 g/cm$^3$) but with optimal mechanical properties and wear resistance, partial or total replacement of WC by lighter carbides, such as TiC and/or NbC was considered since WC is a carbide with a high density (over 15 g/cm$^3$). If those carbides are added in quantities over the solubility limit of the binder, they precipitate and form an additional phase i.e., the cubic carbides or gamma phase. Usually, cubic carbides contain all or some of the elements: Ti, Ta, Nb, W, Hf and Zr, and have a core-rim structure.

Despite the beneficial effect in decreasing the density, the addition of the above carbides in large quantities can decrease some of the desired mechanical properties in particular wear resistance. The properties that are more adversely affected by the introduction of cubic carbides are toughness, strength and thermal conductivity. Also, for similar hardness values higher wear rates can be found for those materials when tested in sliding friction conditions, partially related to a lower interfacial strength between the cubic carbides and the binder. On the other hand, some properties might be improved through the addition of cubic carbides, such as hot hardness and resistance to plastic deformation. Also, the gamma phase might contribute to reduce friction forces and act as an anti-galling agent.

One of the main wear mechanisms for sintered pieces containing high cubic carbide contents that are subjected to wear tests is the pull-out of individual or clusters of carbide grains. This preferential pull-out is mainly related to a poor interfacial strength between the carbide and the binder, and it accelerates wear rates due to two main reasons. Firstly, wear rates increase because full carbide grains are easily de-attached from the surface. Secondly, the detached grains tend to sit between the hard metal piece and the workpiece material. Since they have high hardness levels, they act as abrasive media, promoting abrasive wear mechanisms. In order to decrease grain pull-out and minimize their effects, it was one aim to develop grades with a refined gamma phase grain size and an improved interfacial strength.

Refinement of the Gamma Phase

In order to decrease the grain size of the gamma phase two strategies were applied: (1) the addition of TiN or TiCN, and (2) the use of pre-alloyed gamma phase powder.

On the one hand, TiC is a low-density carbide (i.e. density around 4.9 g/cm$^3$) and therefore, its addition to the composition contributes to a decrease the overall density of the material. Accordingly, the developed grades may have relatively high TiC content, i.e., between 7.5% wt to 15% wt i.e., corresponding to a volume content between 15% to 30%, as can be seen in Table 1. On the other hand, it is known that TiN and TiCN are used to refine grain size and improve the strength in TiC-based cermets. Consequently, since TiC may be one of the main gamma phase elements, it was of interest to evaluate the effect of TiN and/or TiCN in reducing the grain size of the gamma phase. In doing so, the microstructure of materials with similar composition both with and without the addition of TiN was evaluated.

Figure 2:
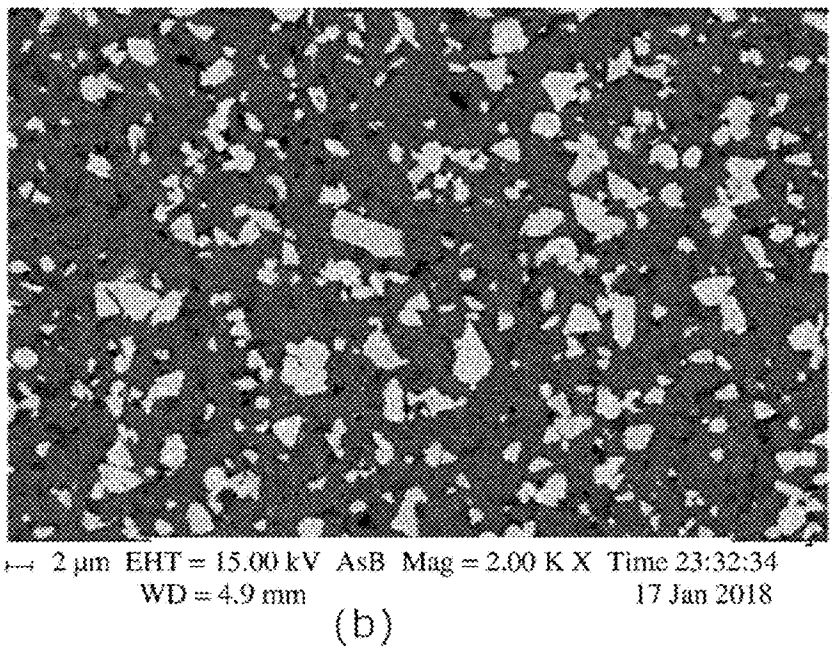
FIG. 2 are micrographs at 2000× magnification of: (a) sample C (without TiN and/or TiCN in its composition) and (b) sample D (TiN and/or TiCN included)
Figure 2:
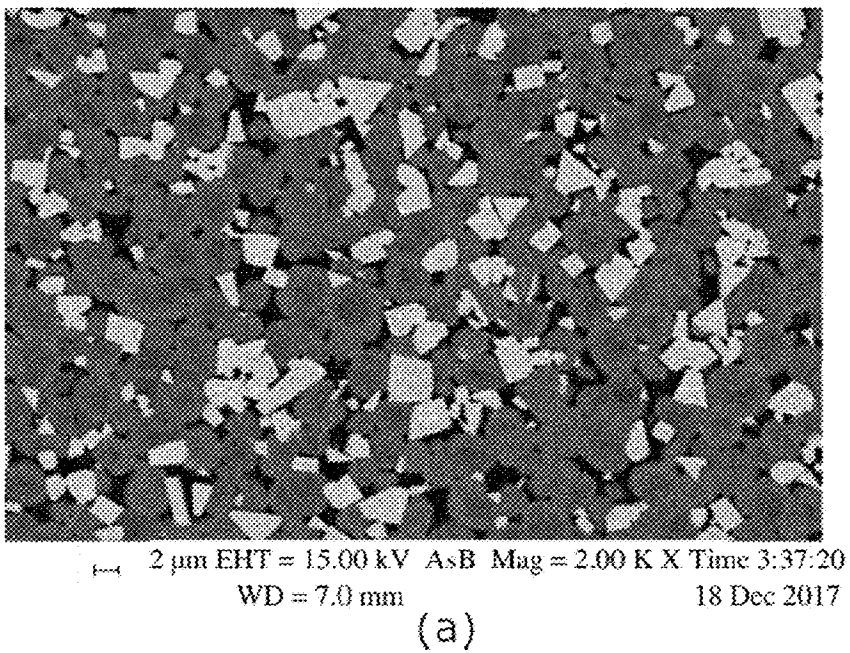
Figure 3:
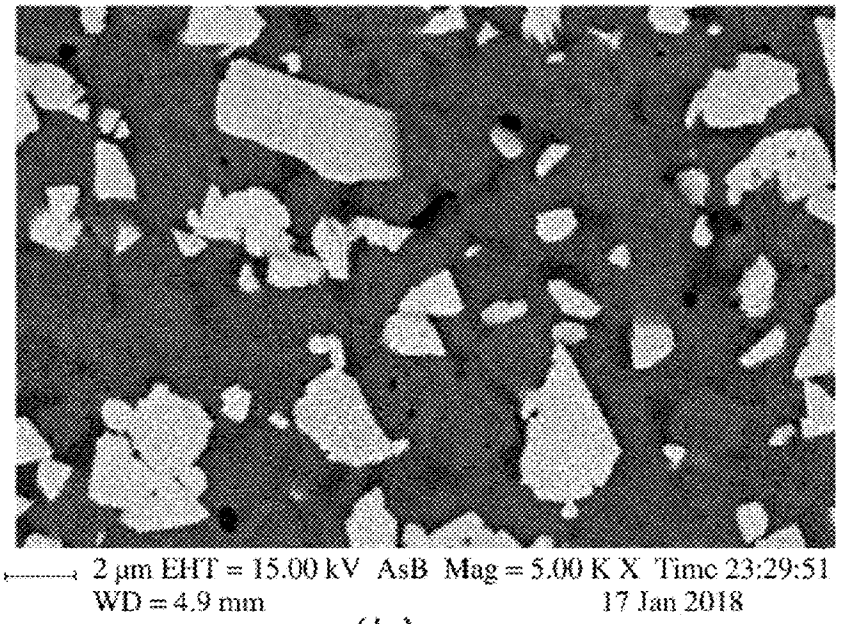
FIG. 3 is micrographs at 5000× magnification of: (a) sample C (without TiN and/or TiCN in its composition) and (b) sample D (TiN and/or TiCN included)
Figure 3:
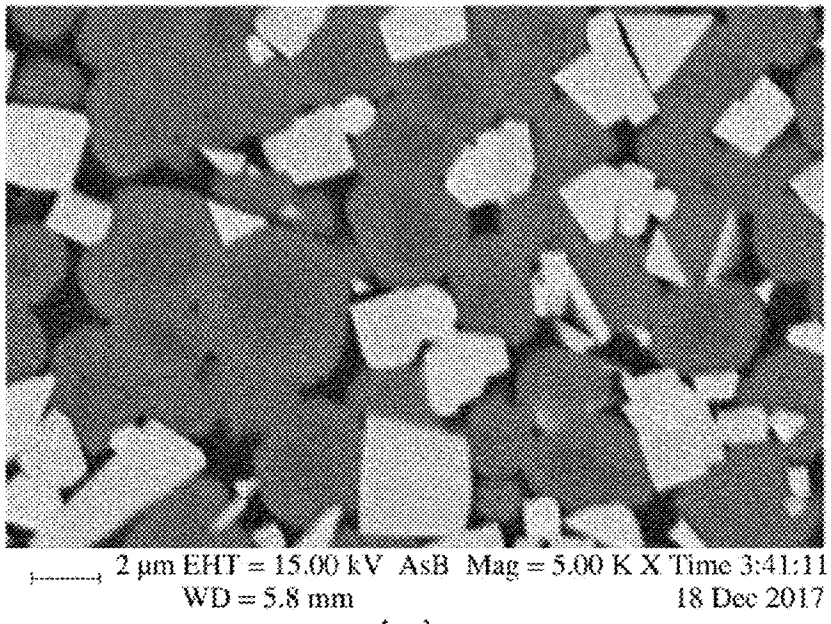

FIG. 2 are micrographs at 2000× magnification of: (a) material C (without TiN and/or TiCN in its composition) and (b) material D (TiN and/or TiCN included). FIG. 3 are micrographs at 5000× magnification of: (a) material C (without TiN and/or TiCN in its composition) and (b) material D (TiN and/or TiCN included). As will be noted from the microstructures of FIG. 2 and FIG. 3, the use of TiCN significantly reduces the mean grain size of the gamma-phase in the sintered material. Importantly, the mean WC grainsize, in light grey, was also reduced but to a lower degree.

Pre-Alloyed Gamma Phase

Figure 4:
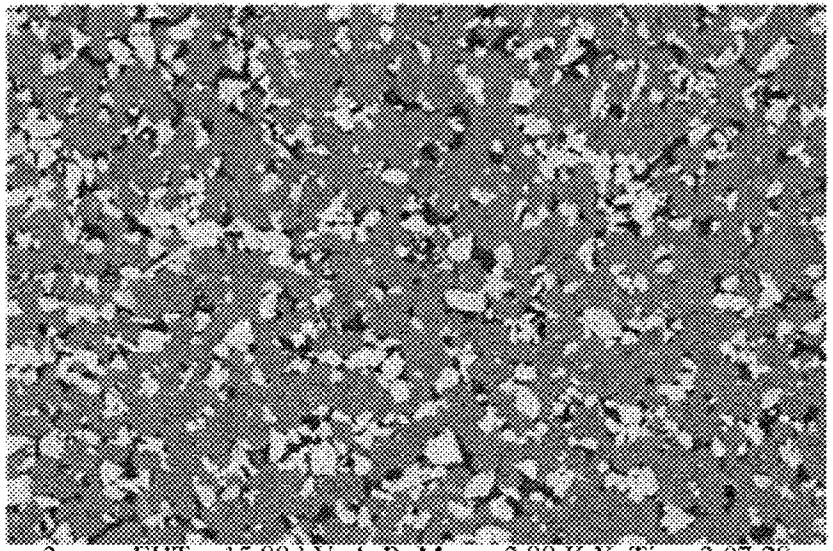
FIG. 4 is micrographs at 2000× magnification of: sample A (without pre-alloyed gamma-phase) and sample B (with pre-alloyed gamma-phase)
Figure 4:
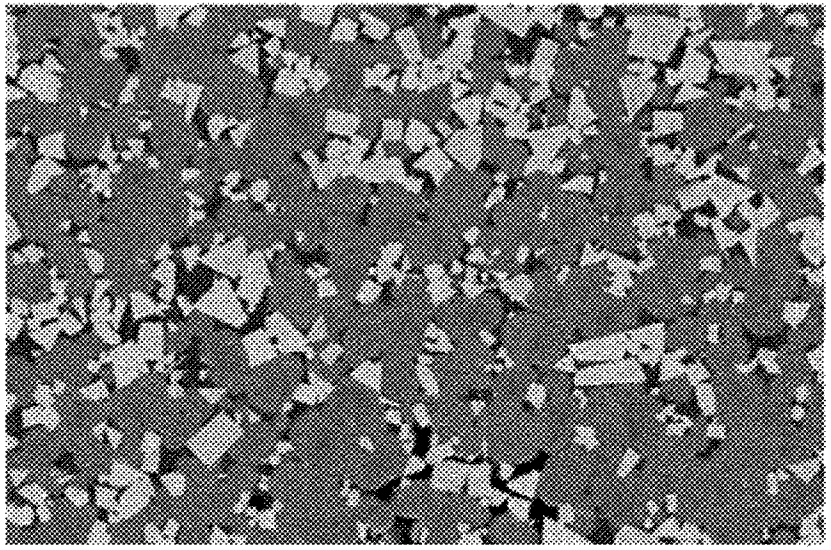
Figure 5:
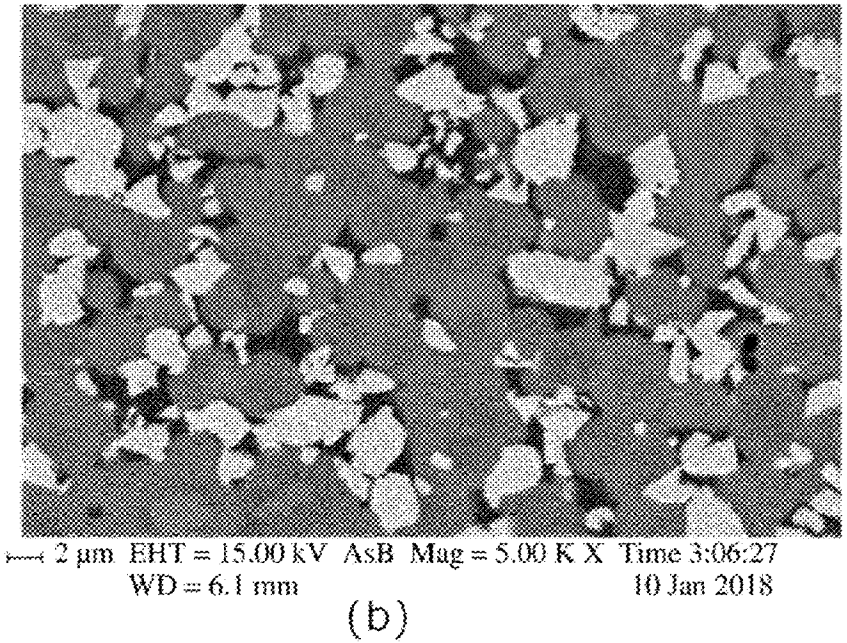
FIG. 5 is micrographs at 5000× magnification of: sample A (without pre-alloyed gamma-phase) and sample B (with pre-alloyed gamma-phase)
Figure 5:
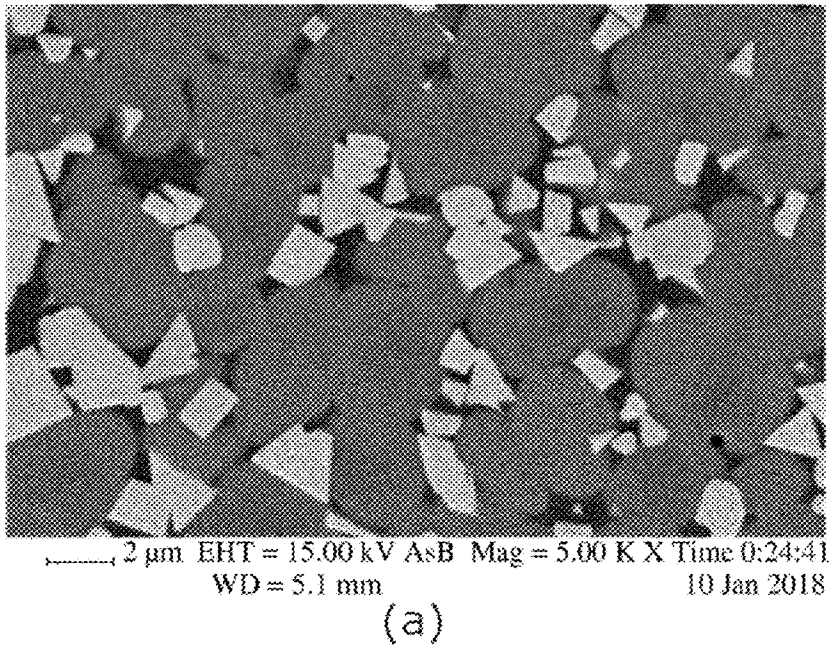

The influence of a pre-alloyed gamma phase (i.e. (W Ti Ta)C) as a gamma phase grain growth inhibitor was evaluated. It was observed that the use of pre-alloyed gamma phase significantly reduces the mean grain size of the gamma phase in the sintered material. However, it also reduces the mean WC grain size. A clear example is shown when comparing the microstructures of samples A and B. In particular, FIG. 4 is micrographs at 2000× magnification of: sample A (without pre-alloyed gamma-phase) and sample B (with pre-alloyed gamma-phase) and FIG. 5 is micrographs at 5000× magnification of: sample A (without pre-alloyed gamma-phase) and sample B (with pre-alloyed gamma-phase). The use of pre-alloyed gamma phase significantly reduces the mean grain size of the gamma-phase in the sintered material. It will be noted the mean WC grain size, in light grey, is also reduced as seen at 2000× (FIG. 4) and 5000× (FIG. 5).

Combination of TiN/TiCN and Pre-Alloyed Gamma Phase

Figure 6:
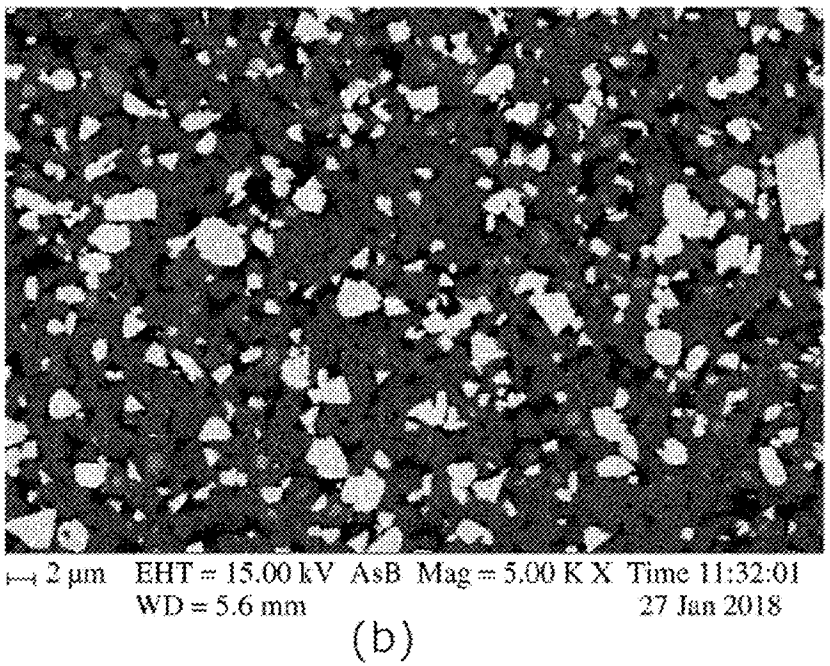
FIG. 6 is micrographs at 2000× magnification of: (a) sample E (without pre-alloyed gamma-phase) and sample F (with pre-alloyed gamma-phase)
Figure 6:
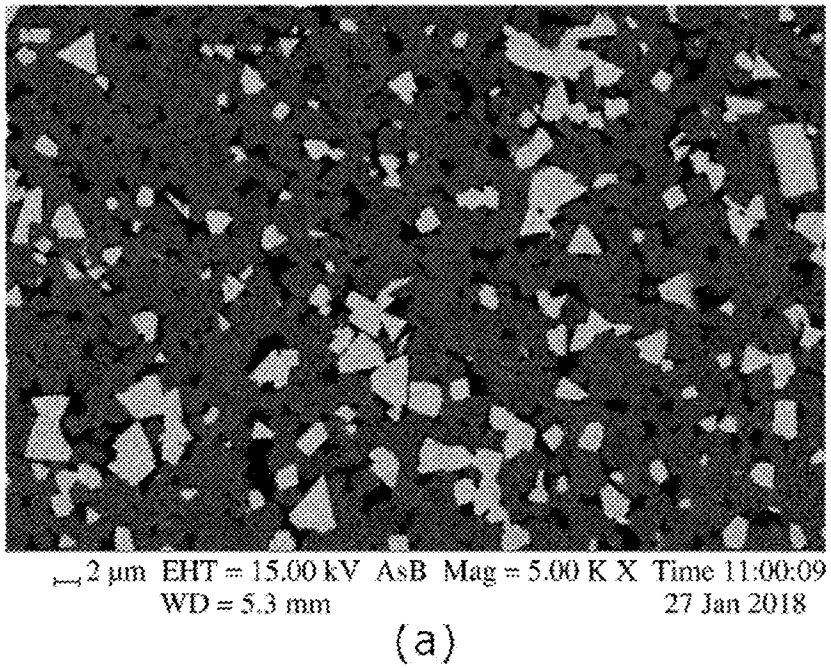
Figure 7:
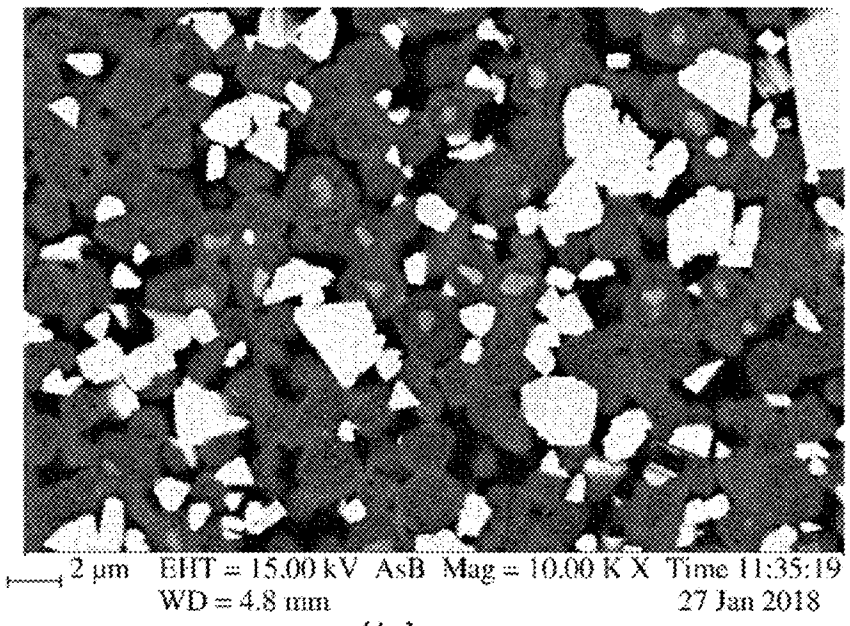
FIG. 7 is micrographs at 5000× magnification of: (a) sample E (without pre-alloyed gamma-phase) and sample H (with pre-alloyed gamma-phase)
Figure 7:
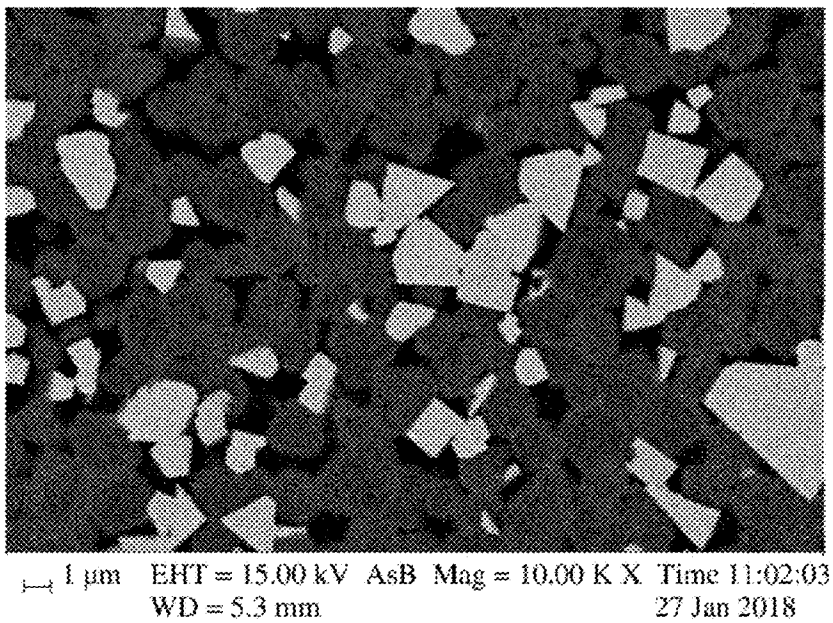

Both strategies can be combined if the grain size of the gamma phase is to be further reduced. An example is shown in FIG. 6 and FIG. 7, at 2000× and 5000×, for materials E and H where FIG. 6 is micrographs at 2000× magnification of: (a) sample E (without pre-alloyed gamma-phase) and sample F (with pre-alloyed gamma-phase) and FIG. 7 is micrographs at 5000× magnification of: (a) sample E (without pre-alloyed gamma-phase) and sample F (with pre-alloyed gamma-phase). Both sample materials E and F have similar compositions, but material E combines TiN and pre-alloyed gamma phase, whereas material F has the same amount of TiN as material E, but does not contain pre-alloyed (W,Ti,Ta)C gamma phase The use of pre-alloyed gamma phase, in addition to TiN, reduces slightly more the gamma-phase mean grain size as compared with the material with only TiN. It was noted that at this stage the additional grain refinement obtained was limited.

Interfacial Strength

As mentioned, one objective of the present invention is to increase the interfacial strength between the gamma phase and the binder to reduce grain pull-out during wear. In order to do so, the addition of several additives such as $Mo_2C$, TaC and $Cr_2C_3$, as well as the use of pre-alloyed gamma phase, was evaluated. However, it is extremely difficult to measure interface strength and therefore, indirect techniques were used. In doing so, interfacial strength was evaluated by studying the response of the materials to crosshatching and wear.

Hardness, Palmqvist Toughness and Density

The hardness, Palmqvist toughness and density of the studied materials are shown in Table 2. Please note that all material samples A to I have similar densities of between 9.99 and 10.72 g/cm$^3$. In addition, no significant changes in HV to KIc relation were found except for grades A and F, with A the grade with the poorest HV to KIc relation, and F the grade with the best. It was noted that, as expected, the materials with finer gamma phase grain size (i.e grades B and D), had higher hardness levels than their respective counter grades (i.e grades A and C).

TABLE 2

Density, hardness and toughness of studied grades

| Grade | Density (g/cm3) | HV30 | K1C ISO28079 (MPa/√m) |
|---|---|---|---|
| A | 10.59 | 1461 | 8.77 |
| B | 10.72 | 1595 | 8.30 |
| C | 9.99 | 1464 | 9.49 |
| D | 10.09 | 1483 | 9.05 |
| E | 10.01 | 1349 | 10.25 |
| F | 10.00 | 1411 | 10.50 |
| G | 10.60 | 1355 | 10.50 |
| H | 10.06 | 1359 | 10.40 |
| I | 9.90 | 1400 | 9.50 |

Material Performance

Crosshatching Resistance

Samples were texturized to simulate crosshatching process carried out by can makers.

Interfacial strength between the binder and the hard particles was evaluated by SEM inspection after crosshatching simulation, as well as the wear damage produced by the process itself in the surfaces of the samples.

Figure 8:
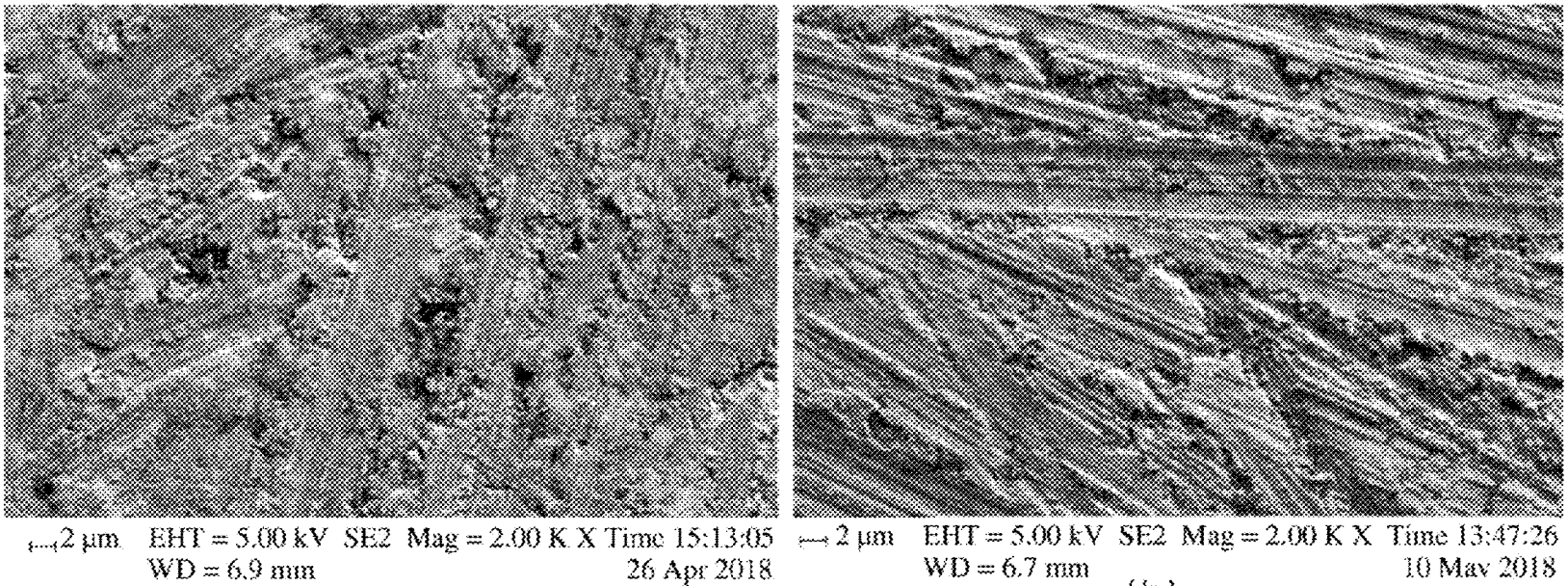
FIG. 8 is magnified images of crosshatching simulation in: (a) sample E and (b) sample I.

FIG. 8 are magnified images of crosshatching simulation in: (a) sample E and (b) sample I. As it can be seen in FIG. 8, WC grain fragmentation and debonding are observed in both samples due to the high stresses of the diamond abrasive grains during the process. Nevertheless, sample I showed slightly more surface damage and more grains pull-out. Accordingly, it is suspected that adhesion wear mechanisms during in-service performance (Al or steel galling) would be enhanced potential leading to early tool failure.

Sliding Wear Response

Figure 9:
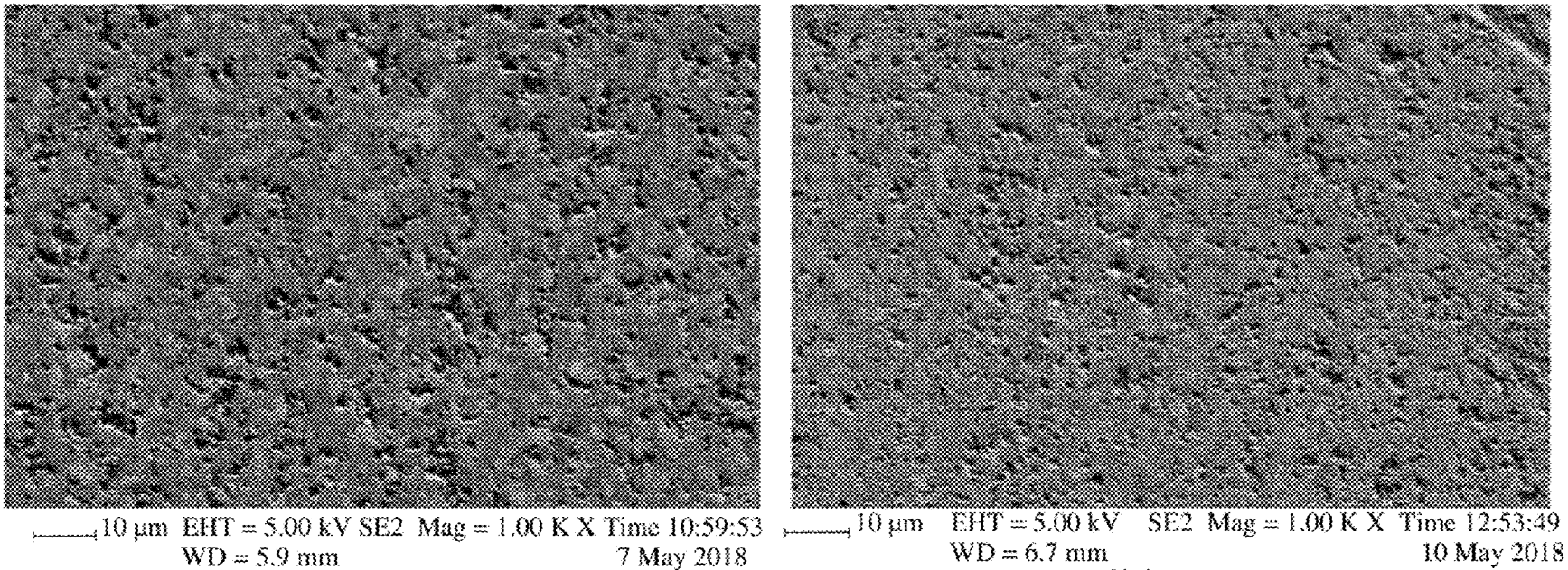
FIG. 9 is magnified images of the worn surfaces after sliding wear test of: (a) sample E and (b) sample I.

The wear damage (abrasion) was evaluated using a $Al_2O_3$ ball. FIG. 9 is magnified images of the worn surfaces after sliding wear test of: (a) sample E and (b) sample I. The wear track depths for grade E and I were 2.20±0.18 μm and 2.76±0.08 μm respectively, indicating that sample I suffers larger wear damage. In particular, as can be seen in FIG. 9, the worn regions that correspond to the respective wear tracks are quite similar, showing a smooth surface with initial asperities from the crosshatching having ploughed away. Also grain pull out due to the abrasive effect of the hard counterpart was observed. Despite these similarities, sample I has larger amount of TiC which is hard but brittle, therefore being able to promote further abrasive effect if it is chipped or detached. This confirms the measurement of deeper wear tracks in sample I. The presence of refined gamma phase is also determinant in that the interfaces are better adhered, presenting better resistance to grain pull out.

Figure 10:
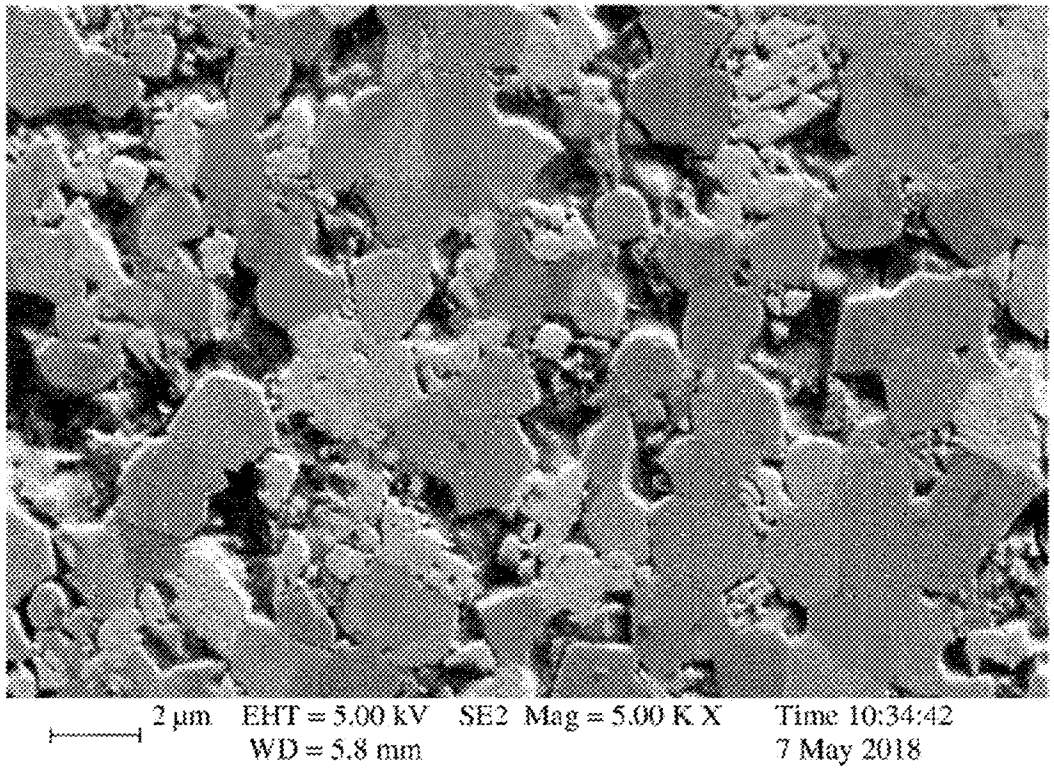
FIG. 10 is a micrograph at 5000× magnification of a worn surface of sample F after sliding wear test.

FIG. 10 is a micrograph at 5000× magnification of a worn surface of sample F after sliding wear test. As can be seen, some WC gains appear to be chipped and some pitting is preferentially observed, indicating the sample is susceptible to tribocorrosion damage (abrasive+lubricant effect).

Figure 11:
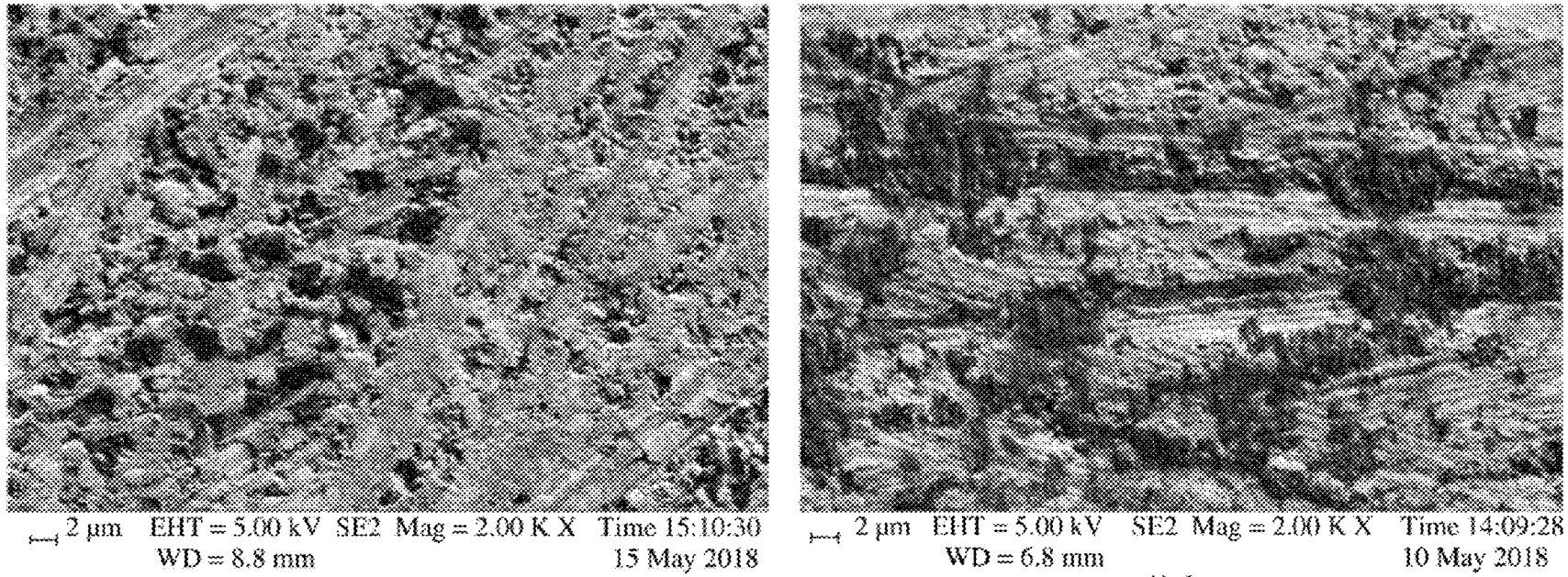
FIG. 11 is SEM images of adhesive wear response of: (a) sample E and (b) sample I.

The adhesive wear was analyzed by using an Al ball. FIG. 11 is SEM images of adhesive wear response of: (a) Sample E and (b) Sample I. From FIG. 11*b* it can be seen that sample I exhibits a larger amount of galling (Al adhesion), both at the scratches and at the grain pull outs left by crosshatching, whereas sample E mainly shows galling within the regions of grain pull out as can be seen from FIG. 11*a*. As commented, sample I shows poorest performance under crosshatching, leaving further grain pull out and cracking providing more regions to which the Al may adhere. Also, the higher amount of binder in sample I allows for more welding. The local galling at all these regions would promote full grain detachment.

CONCLUSIONS

A wear resistant lightweight cemented carbide grade with density <10.0 g/cm$^3$, hardness HV30 1300-1500 and fracture toughness 10-11 MPa m was successfully developed. Unless defined otherwise all technical and scientific terms used herein have the same meaning as commonly understood to one of ordinary skill in the art to which the presently described subject matter pertains.

Unless otherwise indicated, any reference to "wt %" refers to the mass fraction of the component relative to the total mass of the cemented carbide.

Where a range of values is provided, for example, concentration ranges, percentage range or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

It should be understood that the terms "a" and "an" as used above and elsewhere herein refer to "one or more" of the enumerated components. It will be clear to one of ordinary skill in the art that the use of the singular includes the plural unless specifically stated otherwise. Therefore, the terms "a", "an" and "at least one" are used interchangeably in this application.

Unless otherwise indicated, all numbers expressing quantities of ingredients, properties such as size, weight, reaction conditions and so forth used in the specification and claims are to be understood as being modified in all instances by the term "about". Accordingly, unless indicated to the contrary, the numerical parameters set forth in the following specification and attached claims are approximations that may vary depending upon the desired properties sought to be obtained by the present subject matter. At the very least, and not as an attempt to limit the application of the doctrine of equivalents to the scope of the claims, each numerical parameter should at least be construed in light of the number of reported significant digits and by applying ordinary rounding techniques.

Throughout the application, descriptions of various embodiments use "comprising" language; however, it will be understood by one of skill in the art that, in some instances, an embodiment can alternatively be described using the language "consisting essentially of" or "consisting of".

The present subject matter being thus described, it will be apparent that the same may be modified or varied in many ways. Such modifications and variations are not to be regarded as a departure from the spirit and scope of the present subject matter, and all such modifications and variations are intended to be included within the scope of the following claims.

The invention claimed is:

1. A cemented carbide, comprising:

a hard phase comprising WC, the WC being present in an amount of from 50 to 70 wt. % based on a total weight of the cemented carbide;

a binder phase comprising Co, Ni, Fe, Mo, and Cr, the Cr being present in an amount of from 0.2 wt. % to 0.6 wt. % based on a total weight of the cemented carbide; and a gamma phase comprising at least one metal carbide in combination with at least one metal nitride and/or metal carbonitride, wherein a quotient of an average grain size of the WC/an average grain size of the gamma phase is in a range of from 0.5 to 1.5, and wherein the cemented carbide has a fracture toughness in a range of from 10 MPa m$^{1/2}$ to 11 MPa m$^{1/2}$.

2. The cemented carbide according to claim 1, wherein the at least one metal carbide comprises anyone or a combination of: TiC, TaC, VC, NbC, ZrC, HfC, $Mo_2C$, $Cr_2C_3$, the at least one metal nitride comprises anyone or a combination of: TIN, TaN, VN, NbN, ZrN, HfN, WN, MON, CrN, and/or the metal carbonitride comprises anyone or a combination of: TiCN, TaCN, VCN, NbCN, ZrCN, HfCN, WCN, MoCN, CrCN.

3. The cemented carbide according to claim 1, wherein the average grain size of the WC is in a range of from 0.5 to 2 μm.

4. The cemented carbide according to claim 1, wherein the average grain size of the gamma phase is in a range of from 0.5 to 2 μm.

5. The cemented carbide according to claim 1, wherein the WC is present in an amount of from 50-65 wt. % based on a total weight of the cemented carbide.

6. The cemented carbide according to claim 1, wherein the Co and the Ni is are present in an amount of from 10-20 wt. % based on a total weight of the cemented carbide.

7. A tool for metal forming or metal cutting, comprising a cemented carbide according to claim 1.

8. A punch for metal forming, comprising a cemented carbide according to claim 1.

9. A method of making a cemented carbide comprising a hard phase including WC, a binder phase, and a gamma phase, the method comprising:

preparing a batch of powdered materials comprising WC, the WC being present in an amount of from 50 to 70 wt. % based on a total weight of the batch of powdered materials, binder phase constituents comprising Co, Ni, Fe, Mo, and Cr, and gamma phase constituents comprising at least one metal carbide in combination with at least one metal nitride and/or metal carbonitride;

milling the batch of powdered materials;

pressing the milled batch of powdered materials to form a pre-compact; and sintering the pre-compact, wherein in the sintered pre-compact, a quotient of an average grain size of the WC/an average grain size of the gamma phase is in a range of from 0.5 to 1.5, wherein the Cr is present in the cemented carbide in an amount of from 0.2 wt. % to 0.6 wt. % based on a total weight of the cemented carbide, and wherein the cemented carbide has a fracture toughness in a range of from 10 MPa m$^{1/2}$ to 11 MPa m$^{1/2}$.

10. The method according to claim 9, wherein the WC is present in the batch of powdered materials in an amount of from 50 to 65 wt. % based on a total weight of the batch of powdered materials.

11. The method according to claim 9, wherein the at least one metal carbide comprises anyone or a combination of: TiC, TaC, VC, NbC, ZrC, HfC, the at least one metal nitride comprises anyone or a combination of: TIN, TaN, VN, NbN, ZrN, HfN, and/or the metal carbonitride comprises anyone or a combination of: TiCN, TaCN, VCN, NbCN, ZrCN, HfCN.

12. The method according to claim 9, wherein the gamma phase constituents in the batch of powdered materials comprise TiC, NbC, TaC, TiN and/or TICN.

13. The method according to claim 12, wherein the batch of powdered materials further comprises $Cr_3C_2$ and/or $Mo_2C$.

14. The method according to claim 9, wherein the batch of powdered materials comprises in wt. %:

55-59 of the WC based on a total weight of the batch of powdered materials;

10-14 of TiC based on a total weight of the batch of powdered materials;

8-12 of NbC based on a total weight of the batch of powdered materials;

5-13 of the Co based on a total weight of the batch of powdered materials;

0.1-1.0 of $Cr_3C_2$ based on a total weight of the batch of powdered materials;

1-9 of the Ni based on a total weight of the batch of powdered materials;

0.1-1.0 of $Mo_2C$ based on a total weight of the batch of powdered materials;

0.5-2.5 of TaC based on a total weight of the batch of powdered materials; and 1-7 of TiCN and/or 1-5 of TiN based on a total weight of the batch of powdered materials.

15. The method according to claim 9, wherein the gamma phase constituents comprise pre-alloyed metal carbides, and metal nitrides and/or metal carbonitrides.

* * * * *